United States Patent [19]

Wood

[11] 4,025,385

[45] May 24, 1977

[54] LABEL APPLICATORS

[75] Inventor: William Wood, Naphill, England

[73] Assignee: Green Shield Trading Stamp Company Limited, Edgware, England

[22] Filed: Nov. 5, 1975

[21] Appl. No.: 629,132

[30] Foreign Application Priority Data

Nov. 14, 1974 United Kingdom ..... 49348/74

[52] U.S. Cl. ..... 156/568; 156/571; 156/DIG. 31

[51] Int. Cl.[2] ..... B65C 9/08

[58] Field of Search ..... 156/272, 285, 297, 320, 156/380, 565, 568, 569, 570, 571, DIG. 29, DIG. 30, DIG. 31, DIG. 45

[56] References Cited

UNITED STATES PATENTS

| | | | |
|---|---|---|---|
| 2,214,096 | 9/1940 | Weiss | 156/568 |
| 2,773,617 | 12/1956 | Weiss | 156/568 |
| 3,508,993 | 4/1970 | Belcher et al. | 156/380 |
| 3,748,210 | 7/1973 | Beutl | 156/571 |
| 3,864,187 | 2/1975 | Carter | 156/571 |
| 3,915,338 | 10/1975 | Kronseder | 156/DIG. 29 |
| R23,512 | 6/1952 | Von Hote | 156/320 |

*Primary Examiner*—Charles E. Van Horn
*Assistant Examiner*—John E. Kittle
*Attorney, Agent, or Firm*—Young & Thompson

[57] ABSTRACT

A label applicator has a rotating head assembly for carrying labels from a hopper for application to articles to be labelled. The labels are held on the head assembly by suction. To load labels from the hopper, the hopper is reciprocated towards a spring loaded suction head of the head assembly, depressing the head thereby connecting suction to it, and then away again. A latch locks the head in a depressed state so that a label is withdrawn from the hopper. The head assembly is driven stepwise to stop temporarily for loading a label on each head. The latch is released allowing the loaded head to spring forward when it has rotated to a desired orientation on the head assembly. The released head presses the label onto the article to be labelled simultaneously disconnecting the suction. For heat activated adhesive labels, a radiant heater, preferably a quartz infra-red tube, is arranged to irradiate labels when loaded on the suction heads.

13 Claims, 8 Drawing Figures

100
101
102
103
104
105
106
107
108
109
110
111
112
113
114
115
116
117
118
32
33
34

LABEL APPLICATORS

This invention relates to label applicators and particularly, in one aspect, to apparatus for applying heat activated adhesive labels to containers, packages or other goods. The apparatus of the invention can also be used for applying thin wafer-like sachets or like devices to containers, packages or other goods. Thus, when the term label is used herein it should be understood to include such alternative devices.

Various label applicators are known, such as those described in British Pat. No. 766836 to Weiss or U.S. Pat. No. 2668632 to Zimpel.

According to the invention, a label applicator comprises a hopper for holding a stack of labels, a rotatable head assembly for carrying labels from the hopper for application, the head assembly having at least one depressable suction head having a suction surface for holding a single label and means resiliently opposing depression of said at least one suction head; a stepping drive mechanism operable to rotate the head assembly so that said at least one suction head successively registers with the hopper for receiving a label therefrom; actuating means synchronised with the stepping drive mechanism to effect a single reciprocation, comprising a forward and a return stroke, of the hopper when said at least one suction head is in registration, whereby the hopper depresses the registering suction head with the end label of the stack engaging the suction surface thereof; valve means operating on depression of the registering suction head to apply suction or located near to the suction surface thereof, whereby to hold the end label on the suction head; latching means operative to prevent return movement of the depressed suction head under the influence of the resiliently opposing means, whereby the end label is withdrawn from the stack and held by the depressed suction head on the return stroke of the hopper; and release means arranged to cause the latching means to release the depressed suction head, thereby disconnecting suction therefrom, when the depressed suction head is bought from registration with the hopper to a predetermined orientation by rotation of the head assembly.

In use, the applicator apparatus is positioned relative to containers, packages or other goods requiring labelling, so that release of the depressed suction head when at said predetermined orientation causes the label held by the suction head to be pressed thereby onto a respective container, package or item of goods. Thus, the apparatus obviates any need for the goods being labelled to be themselves moved into and then out of contact with the suction head during the label application process. Instead, it is only necessary for an item of goods to occupy a predetermined position in which the label can be applied to it by the released suction head. Therefore, this applicator apparatus does not require any special goods conveying apparatus but, rather, can be secured to the delivery end of a packaging, wrapping or filling machine so as to apply labels or sachets to items of goods on the conveyor usually employed with such machines.

Further, the applicator of the present invention can be used for labelling articles or a range of different shapes. The applicator can be disposed so that labels are positively applied to articles on a conveyor with simultaneous disconnecting of the suction influence from the suction heads. Thus, no special arrangements need be made for detaching the labels from the suction heads and the applicator can run at high labelling speeds with minimal danger of labels failing to stick to labelled articles and being carried on by the suction heads.

Conventiently, the applicator is used for the application of heat activated adhesive labels, in which case there is provided a heater arranged for activating the adhesive on labels while they are carried by suction heads from the hopper to the predetermined orientation by rotation of the head assembly.

Normally, the rotatable head assembly has two or more and typically five suction heads symmetrically disposed about the axis of rotation of the head assembly and the release means is arranged such that each loaded suction head rotates through more than 180° before reaching said predetermined orientation.

Preferably, the heater comprises an elongate radiant heat source extending substantially in the plane of rotation of the head assembly and positioned to irradiate the adhesive on labels continuously during at least part of their rotational transfer movement with the head assembly. Then, each label can be heated during an appreciable part of its transfer by the head assembly and thus for a sufficient length of time to ensure full activation of the adhesive. It will be noted that with five suction heads and a rotation of more than 180° before reaching the predetermined orientation, there will be at least two dwell periods, whilst following suction heads are loaded, interrupting the rotational transfer movement of each label. The heater preferably has a heat source extending sufficiently to irradiate labels on suction heads during these two dwell periods.

There follows a description of an embodiment of the invention, by way of example only, which refers to the accompanying drawings in which.

Figure 1:
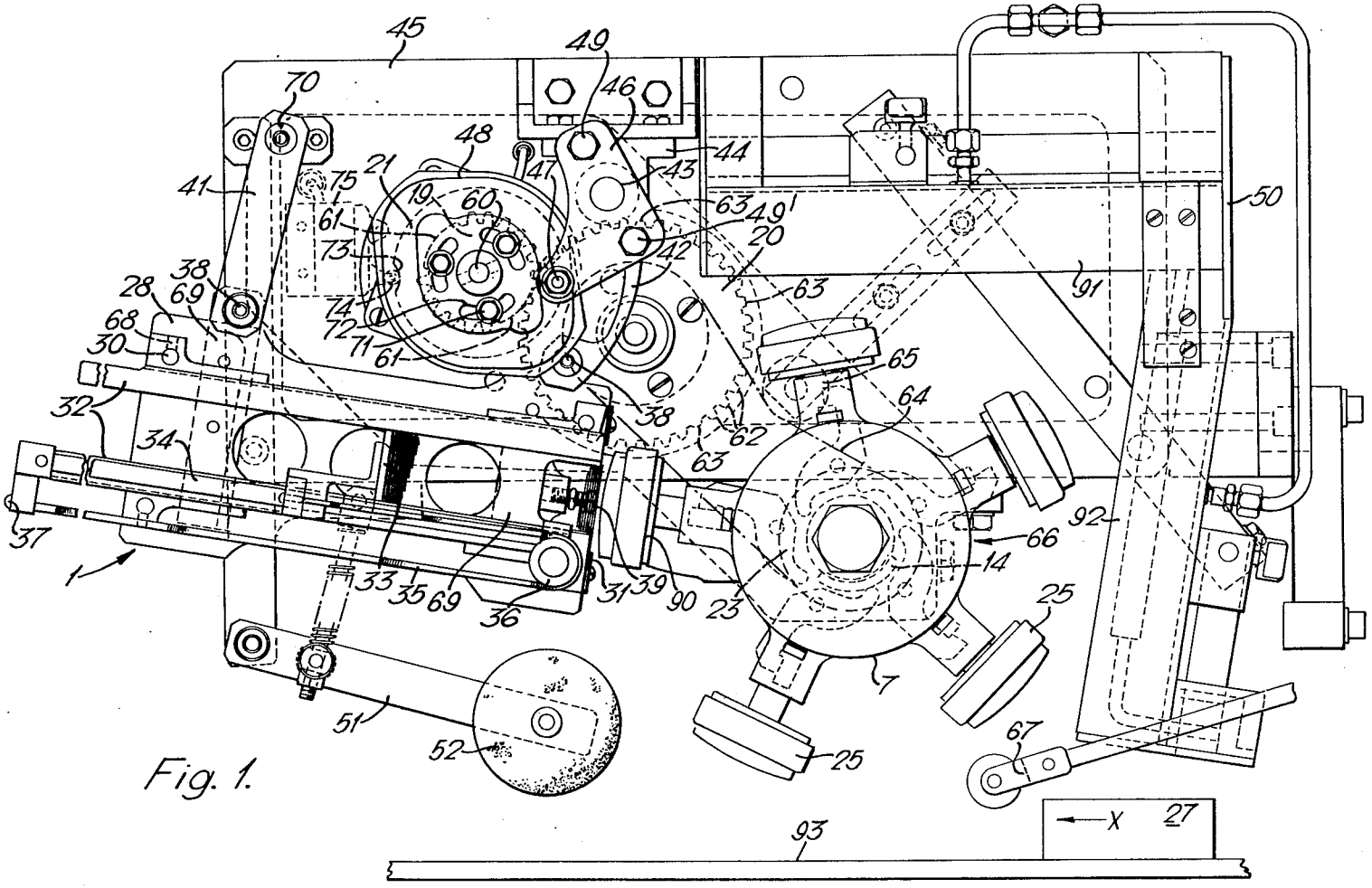
FIG. 1 is a side view of applcator apparatus according to the invention.
Figure 2:
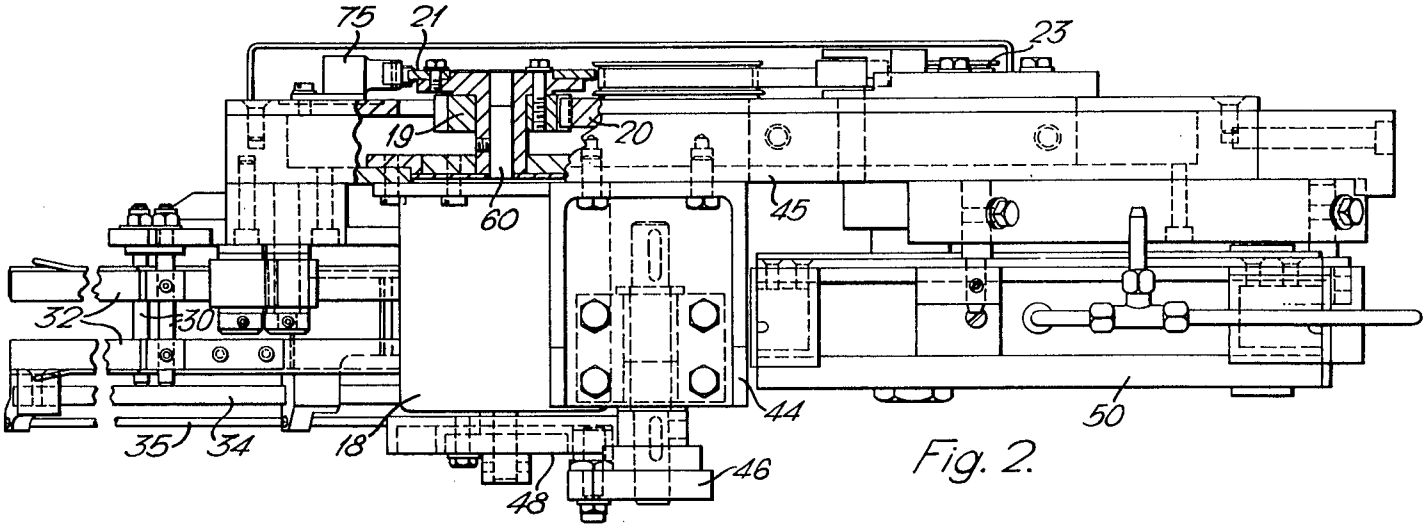
FIG. 2 is a plan view partly in cross-section corresponding to FIG. 1.
Figure 4:
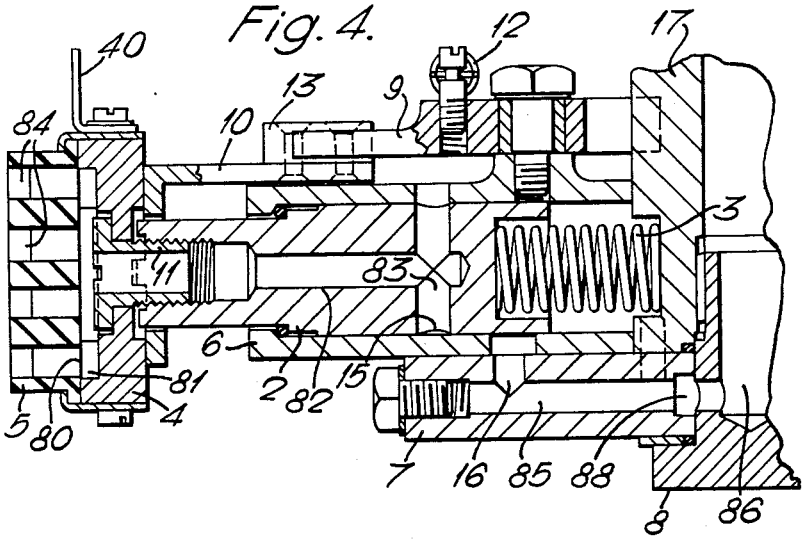
Figure 3:
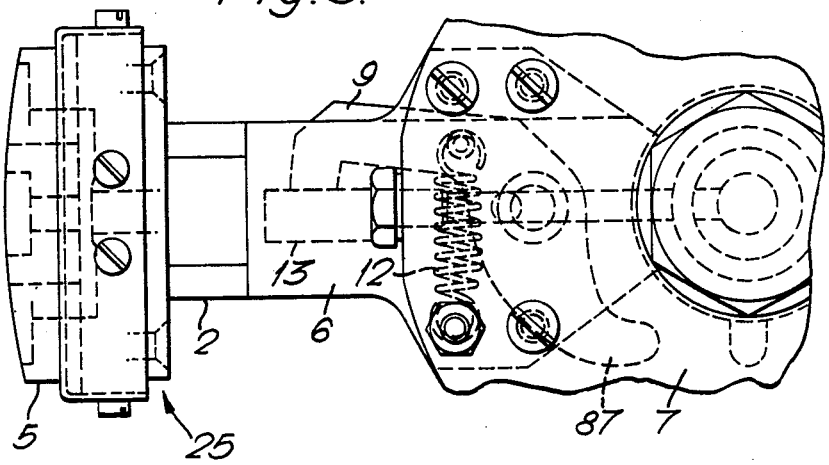
Figures 5, 6:
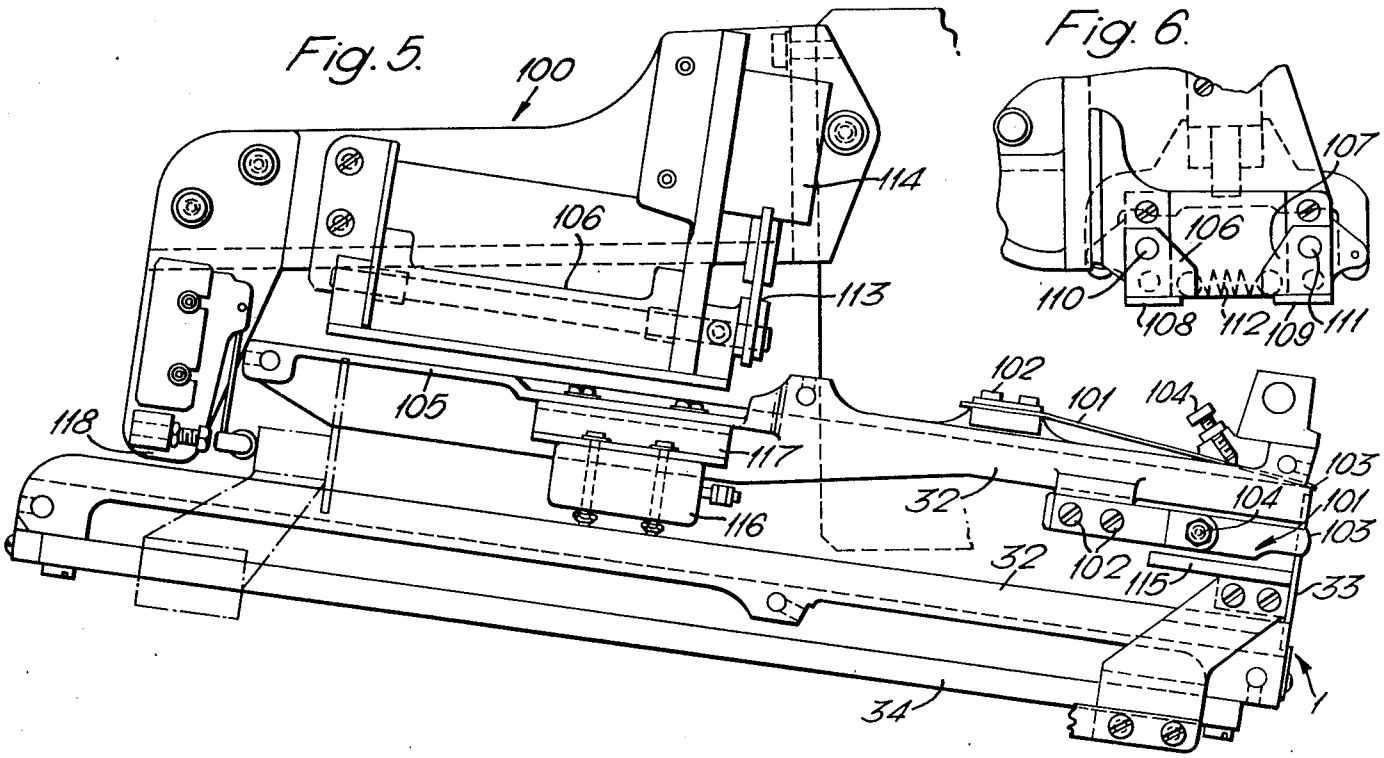
Figure 7:
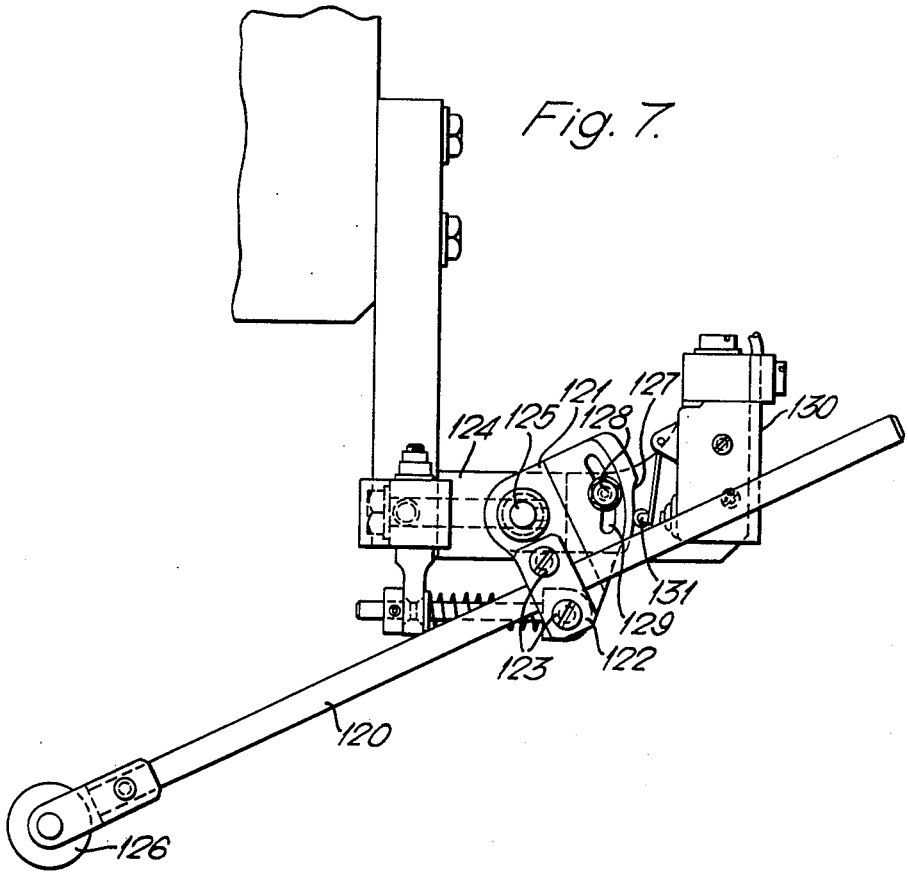
Figure 8:
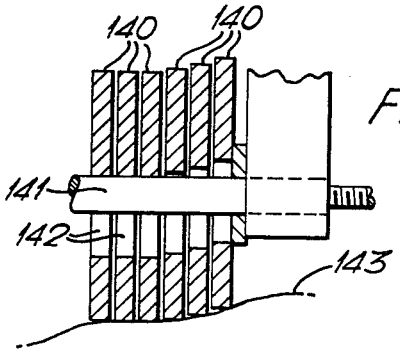

FIG. 3 is an enlarged side view of a suction head of the apparatus of FIGS. 1 and 2, FIG. 4 is a plan view, primarily in cross-section corresponding to FIG. 3, FIGS. 5 and 6 illustrate a preferred form of hopper for the apparatus together with a magazine for reloading the hopper, FIG. 7 illustrates a detector for goods travelling on a conveyor for labelling by the apparatus, and FIG. 8 illustrates a roller arrangement for ensuring secure adhesion of labels or sachets applied to goods by the apparatus.

In the applicator apparatus illustrated in FIGS. 1 and 2, a gear wheel 19 rotates with the drive shaft 60 of a motor 18. The gear wheel 19 has two opposed toothed segments separated by two smooth segments 61 having peripheries defined by the pitch circle of the gear wheel 19. The gear wheel 19 drives a mating gear 20 which has five toothed segments 62 equally spaced around the periphery of the gear wheel 20 and separated by portions 63 in which teeth profiles are shaped to present a concave surface matching the convex surface of the smooth segments 61 of the gear wheel 19. The separation of the axes of the gear wheels 19 and 20 allows a running clearance between the smooth segments 61 and the concave surfaced portions 63. The numbers of teeth on the gear wheel 20 and in the toothed segments of the gear wheel 19 are matched so that, on rotation of the two gear wheels, smooth segments 61 engage in successive concave surface portions of the gear wheel 20. As a result, rotation of the gear wheel 19 causes the gear wheel 20 to rotate by 72° and then to remain stationary during a dwell period whilst a smooth segment 61 of the gear 19 rotates in one of the concave surface portions of the gear 20. The dwell period lasts until the gear wheel 19 has rotated a full 180° after which a further 72° rotation of the gear wheel 20 is effected during further rotation of the gear wheel 19.

A belt 64 transmits drive from the gear wheel 20 to a pulley wheel 23 mounted on the axle of a rotatable head assembly 66. The head assembly 66 comprises a circular plate 7 on which are mounted, symmetrically about the plate 7, five suction heads 25. The belt 64 is a toothed belt and thus ensures that the rotatable head assembly 66 maintains a desired relative orientation with respect to the gear wheel 20. A clamped arm with an idler roller 65 is provided to maintain tension in the belt 64.

A hopper 1 for holding labels, sachets or like devices in a stack is mounted in the applicator apparatus so as to be reciprocatable in a direction parallel to the axis of the stack. The hopper 1 comprises four angle strips 32 adjustably mounted on a plate 28 by means of four pillars 30. The angle strips 32 define a rectangular cross-section channel in which the labels or sachets can be held in a stack. The spacing of the strips 32 is adjustable in one direction by movements of the pillars 30 in slots 68 in the plate 28 and in the other direction by adjustment of mutual spacing along the pillars 30. Thus the channel defined by strips 32 can be arranged to suit the dimensions of rectangular labels or sachets. Two of the strips 32 are shaped to provide an opening through which bundles of sachets can be inserted. The positions of the angle strips 32 can be rearranged to locate the opening in the most convenient position when the applicator is used in any of its different orientations referred to later. A magazine may be attached above the hopper adjacent the opening to enable a reserve supply o sachets to be quickly inserted in the hopper. A preferred arrangement for such a magazine is described later herein.

Two retaining strips 31 are provided at the front end of the hopper projecting slightly inside the inner surfaces of the angular strips 32 so as to provide two parallel lips for retaining labels or sachets at the front end of the stack. Instead of the complete retaining strips 31, which form two parallel edges, the centres of the strips 31 may be removed leaving four triangular shaped ears to retain the sachets. A light pressure is applied to the stack at the back end thereof so as to hold the front label or sachet against the retaining strips 31 by means of a pusher plate 33 which slides freely on a square cross-section bar 34. A spring 35 under tension is anchored at one end to the pusher plate 33 and extends to the front of the hopper where it passes round a pulley wheel 36 and thence extends back to the rear of the hopper to anchorage 37. An arrangement of non-return leaf springs is fitted into the sides of the hopper to retain the labels or sachets in position nearly in a vertical plane when the pusher plate 33 withdrawn to permit a further supply of sachets to be inserted. These are not shown on the drawing.

On an under surface of the hopper 1, there are attached two plates 69 on each of which there is a pivot axle 38. The plate 69 at the front end of the hopper 1 carries a screw 39 which is adjustable to extend forward of this plate 69 by a desired amount.

The hopper 1 is mounted for reciprocating movement on a face plate 45 of the apparatus by means of a rear link arm 41 and a front link arm 42. The rear link arm is pivoted at one end to the hopper at the pivot 38 on the rearward plate 69 and at the other end to the face plate 45 by means of a pivot 70. The front link arm 42 is pivoted at one end to the hopper at the pivot 38 on the forward plate 69. The pivot arm 42 is supported near its other end by a spindle 43. The link arm 42 is keyed to the spindle 43 so that rotation of the spindle moves the link arm 42 thereby effecting a linear motion of the hopper 1. The spindle 43 is supported by a bearing bracket 44 which is secured to the face plate 45. An end of the spindle 43 carries a lever arm 46 to which is attached a cam roller 47 which is arranged to move in the track of a box cam 48 which is fastened to rotate with the gear wheel 19. Angular adjustment between the lever arm 46 and the link arm 42 is permitted by bolts 49 engaging in slotted holes in the lever arm 46. The motion imparted to the cam roller 47 by the box cam 48 is arranged to reciprocate the hopper 1 in synchronism with the stepped drive mechanism which comprises the gear wheels 19 and 20, belt 64 and the pulley wheel 23. The timing of the reciprocating movement of the hopper relative to the movement of the head assembly 66 can be adjusted by varying the relative orientation of the box cam 48 and the gear wheel 19 by means of bolts 71 engaging in arcuately slotted holes 72 in the gear wheel 19.

Instead of the box cam 48, a simple cam plate only may be employed with the lever arm 46 being spring loaded so that the cam roller 47 is resiliently pushed against the profile of the cam plate. Then, the cam plate is effective to move the hopper 1 in the forward direction and allows the hopper to move backwards again under the influence of the spring loading.

A heater arrangement 50 is provided about the head assembly 66 so as to provide heat to activate heat activated adhesive on labels being carried by suction heads 25. The heater arrangement 50 comprises two infra-red heaters 91 and 92 and is controlled by a variable transformer to reduce heat output to minimum sufficient to activate the adhesive on the labels or sachets. Greater heat output is required when the apparatus is operating at maximum speeds, in which case individual labels or sachets spend minimum times exposed to the radiant heat. The two heaters 91 and 92 illustrated each have linear elements and are arranged at an angle so that they irradiate individual labels on suction heads 25 over a larger angle of rotation of the head assembly 66. Radiant heat deflectors (now shown) may be provided to prevent heat from activating the adhesive on labels or sachets in the hopper 1 and also to prevent overheating of moving parts of the apparatus. Also, a shutter mechanism (now shown) may be provided operated, for example, by a solenoid or solenoid valve, to suppress heat radiated from the heaters to the suction heads 65. Further exhaust air from a suction pump applying suction to the suction heads 65 may be used for cooling parts of the apparatus.

Preferably, the elements of the heaters 91 and 92 are infra-red quartz tubes. Such tubes have heat outputs and wavelengths of infra-red radiation which are more controllable, thereby facilitating the prevention of overheating of the moving parts of the apparatus. Quartz infra-red tubes of this sort have the advantage of being able to reach full heat output within approximately one second of switching on and also cool within a similar period of switching off. The heaters 91, 92 may be electrically controlled to switch off automatically if proper operation of the apparatus stops, either because of a fault or in the absence of further goods for labelling. The heat energy from the quartz tubes is distributed evenly over the full width of the labels or sachets on the suction heads 25 by means of gold plated parabolic reflectors.

Referring now to FIGS. 3 and 4, there is shown, in more detail, one of the suction heads 25 on the head assembly 66 of the apparatus of FIG. 1. Each suction head comprises a piston 2 urged by the action of a spring 3 to adopt a position in which the suction head is fully extended. The piston 2 carries a plate 4 in the outer surface 80 of which there are recessed air channels 81. A bore 82 extending coaxially along the piston 2 intersects a transverse bore 83. The plate 4 is fastened to the piston 2 by a hollow screw 11 which provides communication between the bore 82 and the air channels 81. A rectangular heat resisting rubber pad 5 is attached to the surface 80 of the plate 4 and is provided with air holes 84 which communicate with the air channels 81. The air holes 84 connect with recesses on the external surface of the pad 5 to make suction by the pad more effective over a greater area. The piston 2 moves in a housing 6 which is secured to one face of the circular plate 7. The plate 7 has an annular air channel 88 connected with five radial suction holes 85 and is secured by a spigot 8 to a main rotating member 17 of the head assembly 66. The annular air channel 85 communicates with a central air channel 86 of the member 17. A pivoted catch plate 9 is mounted on the piston housing and is arranged to engage a block 13 secured to an angle plate 10 which is fastened to the plate 4 of the suction head. A spring 12 urges the catch plate to engage the block 13 when the plate 4 and piston 2 are pushed in against the action of the spring 3 to a position at which a port 15 of the transverse bore 83 communicates with a port 16 which in turn communicates through the wall of the housing 6 and circular plate 7 with a respective one of the radial suction holes 85. Thus, when the pad 5 and plate 4 are depressed by a predetermined amount catch plate 9 engages block 13 to hold the plate 4 depressed and ports 15 and 16 communicate with each other thereby applying suction to the air holes of the pad 5. The catch plate 9 is provided with a tail 87 which is arranged to engage a trip 14 (best seen in FIG. 1) to release the plate 4 when the heat assembly 66 has rotated to bring the suction head 25 to a desired orientation. The trip 14 is secured to a static frame and is arcuately adjustable to release plate 4 when the head 25 is at a desired orientation.

The opertion of the application will now be described. Objects such as that shown at 27, to which labels, sachets or the like are to be applied by the applicator, are transported past the applicator, for example on a conveyor belt 93, in a direction as indicated by arrow X. A detector 67 detects the passage of an object 27 and, by means of a relay, supplies current to the motor 18 and holds the supply on for approximately 200 milliseconds. Attached to the shaft of the motor 18 there is a switch cam 21 with two diammetrically opposed depressions 73. A switch roller 74 of a microswitch 75 co-operates with the cam 21. The microswitch 75 operates to supply power to the motor 18 when the switch roller 74 is depressed from an extended position in one of the depressions 73. Thus, when the motor is turned on for about 200 milliseconds by the detection of an object by the detector 67, the cam 21 is rotated sufficiently to depress the switch roller 74 so that the supply to the motor is maintained until the cam 21 rotates through 180° and the switch roller 74 registers with the other depression 73. The detector 67 illustrated in FIG. 1 employs a movable finger to detect articles on the conveyor and is described in greater detail later. However, instead of this form of detector a photoelectric detector may be used.

During the first part of the 180° rotation of the cam 21, one of the smooth segments 61 of the gear wheel 19 engages a concave surface portion of the gear wheel 20 and therefore the gear wheel 20 remains stationary. Thus, the head assembly 66 also remains stationary. The relative orientation of the head assembly 66 with respect to the gear wheel 20 is set, by means of the toothed belt 64, so that one of the suction heads 25, that referenced 90 in FIG. 1, registers with the hopper 1. When in registration, the suction head is in close juxtaposition with the front end of the hopper 1 with the piston 2 substantially aligned with the direction of reciprocating motion or the axis of the hopper 1. During the first part of the 180° rotation of the cam 21 the cam roller 47 tracks over an increased radius portion of the box cam 48, causing the lever arm 46 to rotate the spindle 43 and thereby moving the link arm 42 so that the hopper 1 moves towards the axis of rotation of the head assembly 66. An angle piece 40 is adjustably fastened on the plate 4 of each suction head 25 and is positioned so that on movement of the hopper 1 the adjustable screw 39 engages the angle piece 40 causing the piston 2 to be depressed against the action of the spring 3. The adjustable screw 39 and the angle piece 40 are set so that, when piston 2 is depressed, the end member of the stack of labels or sachets in the hopper 1 is held against the suction pad 5 of the suction head 25.

The box cam 48 is arranged to effect sufficient linear movement of the hopper 1 towards the head assembly 66 to depress the plate 4 until the catch plate 9 engages the block 13, thus preventing the plate 4 from moving outwards again under the action of the spring 3. It will be remembered that when the piston 2 is depressed to this position, suction is applied to the pad 5. Thus, when further movement of the box cam 48 causes the hopper 1 to move away from the head assembly 66, the plate 4 and pad 5 remains in the depressed position and the end member of the stack of labels or sachets is gripped by the pad 5 and withdrawn from the stack from behind the retaining plates 31. The box cam 48 is arranged to move the hopper 1 away from the head assembly 66 sufficiently for the front end of the hopper to be clear of the depressed suction pad 5 of the registering suction head 90 and the label or sachet gripped thereby before continued rotation of the gear wheel 19 brings the next toothed segment into engagement with the teeth of the gear wheel 20.

When the hopper 1 is sufficiently withdrawn, the gear wheel 20 is rotated in a clockwise direction by 72°, after which the next smooth segment 61 of the wheel 19 comes into engagement with the following concave surface portion of the wheel 20 and also the switch roller 74 engages in the next depression in the cam 21, thus stopping the motor 18. The 72° rotation of the gear wheel 20 causes a similar rotation of the head assembly 66 which, effectively, replaces the now loaded suction head 25 with the next unloaded suction head on the head assembly.

Subsequent objects 27 detected by the detector 67 cause a repetition of the above described cycle, resulting in a progressive stepped movement of each individual suction head 25 as the head assembly 66 rotates. During the first two positions adopted by each suction head 25 after being loaded with a label or sachet, the gripped labels or sachets are exposed to radiant heat from the heater arrangement 50 causing activation of the adhesive on the labels or sachets. Further rotaton of the head assembly 66 brings each loaded suction head to a predetermined orientation at which the fixed trip 14 engages the tail 87 of the catch plate 9 and releases the plate 4 of the suction head. The plate 4 and pad 5 of the suction head 25 then move out radially of the head assembly 66 under the action of the spring 3 and press the adhesive covered surface of the label or sachet against the passing object 27 with a rolling motion which causes a large proportion of the adhesive surface of the label to adhere to the object. Their motion is produced by a combination of the linear and/or rotary movement of the object and the rotation of the suction head assembly. As the piston 2 extends, the source of suction is disconnected from the pad 5 thus releasing the label.

It will be understood that when a particular object 27 initiates an operating cycle of the applicator by passing the detector 67, it will receive a label or sachet from the loaded suction head released by the trip 14 during that operating cycle. The label or sachet loaded onto a suction head during the cycle initiated by the particular object 27 will, in fact, be applied to the object third after it.

A lightly sprung biassed arm 51 carrying a foam rubber roller 52 is mounted on the apparatus and arranged to roll over labels or sachets applied to objects 27 by the applicator applying a light pressure so as to ensure secure adhesion, particularly to objects with curved surfaces such as bottles and cans.

The described applicator can be mounted in any orientation with respect to the objects requiring labelling. For example suitable orientation allows labels to be applied to the tops of objects or, alternatively, to either side of the objects. Intermediate orientations permit the application of labels to the conical or similar shaped necks of bottles, the aesthetic shaped surfaces of blow moulded containers or other irregular shaped surfaces. The applicator apparatus may be secured to the delivery end of packaging, wrapping or filling machine. However, instead, the applicator may be supported on a free standing frame, preferably one which permits the orientation of the applicator to be adjusted to suit the articles being labelled. For attaching sachets or labels to the vertical sides of cylindrical cans or bottles, it will be necessary to use the apparatus in conjunction with a commerical conveyor which incorporates a bottle rotating device. Many such conveyors are on the market. It is also envisaged to employ the applicator for dropping labels or sachets into open packages or bags from above, without activating the adhesive. This is achieved by switching off the heater arrangement 50, and, or course, ensuring that the head assembly 66 releases the labels above the openings in the packages.

Referring now to FIG. 5, there is shown a preferred arrangement of the hopper for the apparatus in combination with a magazine 100 for providing semi-automatic loading of the hopper with fresh batches of labels or sachets. The magazine 100 is secured to a main frame member of the apparatus and is positioned to be aligned above the hopper so that fresh batches of labels can be dropped from the magazine into the loading opening of the hopper.

The hopper illustrated in FIG. 5 has three retaining fingers 101, one on each side and one at the top edge of the hopper, replacing one of the retaining strips 31 described with reference to FIG. 1. The retaining fingers 101 are made of spring steel and are fastened at one end to the hopper by means of screws 102. The other end 103 of each finger is slightly bent inward so as to extend inside the channel formed by the angle strips 32 to retain the front label in the stack held in the hopper. The pressure that the retaining fingers can apply to the edges of the front label in the stack is adjustable by means of adjustment screws 104.

The two angle strips 32 at the top of the hopper have their upper flanges 105 bent upwards and outwards to provide the opening for entry of a replacement stack of labels into the hopper.

The magazine 100 comprises a pair of flaps 106 and 107 which have ledges 108 and 109 for supporting the stack of labels held in the magazine (see FIG. 6). The flaps 106 and 107 are pivoted at pivot points 110 and 111 respectively to be rotatable above axes substantially parallel with the hopper. The flaps 106 and 107 are resiliently held in the position as indicated in FIG. 6 by means of a spring 112. In the position illustrated in FIG. 6, labels held in the magazine are supported on the ledges 108 and 109. The flaps are linked by a plate 113 which is connected to the spring loaded core of a solenoid 114. The plate 113 is arranged so that energisation of the solenoid 114 rotates the two flaps 106 and 107 simultaneously against the action of the spring 112, so that the ledges 108 and 109 move downwardly, letting the stack of labels supported in the magazine fall through. Thus, when the solenoid 114 is energised, a fresh batch of labels is released from the magazine and drops into the hopper.

During operation of the applicator, the stack of sachets in the hopper is pushed forward by the pusher plate 33 which forms part of the carriage sliding on bar 34, moving forward under the influence of the tension spring 35. The carriage has a projection 115, extending outwardly from the plane of FIG. 5, enabling it to be moved manually backwards against the force of the spring 35, when it is desired to reload the hopper. A microswitch 116 is supported by means of a bracket 117 to one of the angle strips 32. The microswitch 116 is operated as the carriage of the pusher plate 33 has moved forward by a predetermined amount, representing that sufficient sachets have been used from the hopper to leave sufficient space for a fresh batch of labels or sachets to be delivered by the magazine. The operation of the microswitch 116 produces a warning signal, such as a warning light, to warn the operator that reloading is necessary.

The operator may then move the carriage of the pusher plate to the extreme back end of the hopper where it operates a second microswitch 118. The second microswitch 118 effects energisation of the solenoid 114, causing the flaps 106 and 107 of the magazine to open, thereby dropping a fresh batch of labels into the hopper. The operator may then release the carriage of the pusher plate 33 so that the plate takes up a position behind the newly inserted labels or sachets. As the carriage of the pusher plate is released, the microswitch 118 simultaneously de-energises the solenoid 114 so that the flaps 106 and 107 resume their closed position under the influence of the spring 112 in preparation for further sachets or labels to be inserted.

Referring now to FIG. 7, an alternative form of detector device to the photo-electric detector 67 is illustrated. The device is mounted to the frame of the applicator so as to detect packages travelling along the conveyor for labelling at a suitable distance from the labelling position dependant on the speed of travel of the package and the predetermined position for attaching the label or sachet to the package. The detector comprises two fingers 120 which are arranged to be deflected when engaged by a package travelling along the conveyor. The two fingers are in side by side arrangement and only the nearer finger 120 is illustrated in FIG. 7. However, the fingers operate independently and have similar mechanical arrangements. Each finger 120 is secured to a bearing plate 121 by means of a clamp plate 122 which is fastened to the bearing 121 by means of screws 123. The bearing plate 121 is rotatably mounted on a bracket 124 by a journal 125. One end of each finger 120 carries a roller 126. The finger is arranged to trail over the conveyor of packages for labelling with the roller 126 in its lowest position set at a level slightly below the top surfaces of the objects to be labelled so that a package on the conveyor deflects the finger 120 causing rotation of the bearing plate 121. A cam 127 is fastened to the bearing plate 121 by means of a bolt 128. A microswitch 130 is mounted on the bracket 124 and has a cam follower 131 tracking on the cam 127, so that the microswitch is operated when the finger 120 is rotated by engagement with a package by a predetermined amount. The amount of rotation necessary to operate the microswitch 130 can be varied by adjusting the position of the cam 127 relative to the bearing plate 121 by means of an arcuate slot 129 in the bearing plate. When a package has passed the finger 120, the finger returns to its lowest position by its own weight, assisted by a compression spring 132.

The detection device of FIG. 7 is especially effective for detecting the presence of irregularly shaped packages such as the plastics film packages of, for example, confectionary. Consistent detection of the presence of a package for labelling is obtained by arranging the applicator to start operating if either finger 120 is deflected sufficiently to operate its respective microswitch 130. However, when the packages have very irregular surfaces, the detection device may be arranged to initiate applicator operation only when both fingers 120 are deflected, indicating an optimum height of the package. The mechanism of the detector device is, preferably, made from rigid plastics materials of light-weight, thereby avoiding excessive pressure from the fingers 120 on packages covered by unsupported plastics films, such as display boxes of cakes and the aforementioned pillow bags for confectionary.

FIG. 8 illustrates an alternative arrangement for the roller 52 described previously. The roller illustrated in FIG. 8 is especially useful when applying labels or sachets to the undulating surfaces of irregular packages. This roller comprises a number of discs 140 mounted for rotation side by side on a single spindle 141. The discs 140 each have bores 142 that are larger than the diameter of the spindle 141. This enables the discs 140 to move one relative to the other on the spindle so as to accommodate the undulating profile 143 of an irregular package. The discs 140 may be made from brass or of a plastics material. Conveniently, the two outer discs on the spindle 141 are made of brass, whereas the centre discs are made of plastics. The outer discs, being heavier, are, then, more effective at ensuring a good seal between an applied label or sachet and the package along the edges of the label.

As has been indicated previously herein, the described applicator may be used for applying thin wafer-like sachets to containers, packages or other goods. The sachets of particular interest comprise a layer of paper with a covering layer of a transparent sheet material, such as glassine paper or polyester film. A device such as a trading stamp, token, or other relatively flat article can be held in such a sachet between the transparent covering layer and the paper backing. The paper backing is coated with heat activated adhesive for attaching the sachet to a package. The use of quartz infra-red tubes for heating elements in the applicator as described has particular advantages when using the applicator to apply sachets of this kind. If the adhesive is activated by means of a heated shoe in the suction head for carrying the sachets from the hopper, the head conducted from the shoe through the sachet would tend to soften or melt the transparent covering layer of the sachet, if this were made of a plastics film. If, however the sachet employs a glassine covering paper fastened to the paper backing, for example, by a latex based adhesive, the time for the heat from a heated shoe to penetrate the combined thickness of the glassine sheet, any enclosed token or stamp, and the backing paper would be too great to enable high speed operation of the applicator. Further, prolonged exposure to heat might also have a detrimental effect on the latex based adhesive securing the front paper to the backing paper.

Further a quartz infra-red tube emits a relatively short wavelength of infra-red, and, thus, the heat may be focused for application to the adhesive coated surface of the sachets or labels without undue heat penetration into the mechanical parts of the head assembly. The ability of quartz infra-red tubes to cool promptly on being switched off also greatly reduces the chances of accidentally burning labels or sachets if the applicator stops due to a fault. Although the example described herein employs two linear elements for the heater arrangement 50, it is preferable to employ an arcuate element of a curvature corresponding to the size of the head assembly 66.

As described previously, exhaust air from a suction pump applying suction to the suction head 65 may be used for cooling parts of the apparatus, if necessary, and particularly cooling casings for the infra-red quartz tubes. The exhaust air may also be used to supply a low pressure jet of air to the back of the stack of reserve labels held in the magazine 100. It has been found that the friction between the adhesive coated face of this end label and the rear plate of the magazine tends to interfere with the dropping of the reserve stack of labels from the magazine into the hopper. It will be understood that it is desirable that the reserve stack drops, when required, cleanly into the hopper without separating. The tendency of labels and sachets to be somewhat curled, with their adhesive coated faces slighly concave, adds to this interference. This problem can be conveniently overcome by providing a nozzle in the rear plate of the magazine and supplying low pressure exhaust air to the nozzle directed at the rear most label in the stack. The jet of air maintains a spacing between the rear label and the back plate, thereby liminating friction and obviating any interference to the proper dropping of the stack into the hopper.

I claim:

1. A label applicator comprising a reciprocating movable hopper for holding a stack of labels;

a rotatable head assembly for carrying labels from the hopper for application, the head assembly having at least one depressable suction head having a suction surface depression of said at least one suction head;

a stepping drive mechanism operable to rotate the head assembly so that said at least one suction head successively registers with the hopper for receiving a label therefrom;

actuating means synchronised with the stepping drive mechanism to effect a single reciprocation, comprising a forward and a return stroke, of the hopper when said at least one suction head is in registration, whereby the hopper depresses the registering suction head with the end label of the stack engaging the suction surface thereof;

valve means operating on depression of the registering suction head to apply suction to the suction surface thereof, to hold the end label on the suction head;

latching means operative to prevent return movement of the depressed suction head under the influence of the resiliently opposing means, whereby the end label is withdrawn from the stack and held by the depressed suction head on the return stroke of the hopper;

and release means arranged to cause the latching means to release the depressed suction head, thereby disconnecting suction therefrom, when the depressed suction head is brought from registration with the hopper to a predetermined orientation by rotation of the head assembly.

2. A label applicator as claimed in claim 1 for applying heat actuated adhesive labels including a heater arranged for activating the adhesive on labels while they are carried by said at least one suction head from the hopper to the predetermined orientation by rotation of the head assembly.

3. A label applicator as claimed in claim 2 wherein the heater comprises an elongate radiant heat source extending substantially in the plane of rotation of the head assembly and positioned to irradiate the adhesive on labels continuously during at least a part of their rotational transfer movement with the head assembly.

4. A label applicator as claimed in claim 3 wherein the rotatable head assembly has a plurality of said suction heads and the release means is arranged so that each loaded suction head rotates through more than 180° before reaching said predetermined orientation.

5. A label applicator as claimed in claim 4 wherein the head assembly has five said suction heads.

6. A label applicator as claimed in claim 5 wherein the elongate heat source extends sufficiently to irradiate the adhesive on labels during at least two dwell periods in the rotational transfer of the labels from the hopper.

7. A label applicator as claimed in claim 3 wheren the radiant heat source comprises at least one quartz infra-red tube.

8. A label applicator as claimed in claim 7 wherein the heater includes a gold-plated parabolic reflector for said at least one quartz infra-red tube disposed to direct infra-red radiation from the tube at the full width of the labels carried by the suction heads.

9. A label applicator as claimed in claim 1 wherin the stepping drive mechanism comprises a first gear wheel, a motor operable to rotate said first gear wheel about an axis, said first gear wheel having at least one smooth toothless sector having an arcuate convex profile centered at the axis of rotation of the gear wheel and at least one toothed sector having a predetermined number of teeth, a second gear wheel cooperating with said first gear wheel and having a number of concave profiled regions at which teeth of said second gear wheel are shaped to form an arcuate concave profile corresponding to the arcuate convex profile of said at least one toothless sector of the first gear wheel, the peripheral spacing of adjacent said concave profiled regions being such that, on rotation of said first gear wheel, said at least one smooth toothless sector engages in successive said concave profiled regions holding said second gear wheel temporarily stationary, whereby continuous rotation of said first gear wheel effects a stepped rotation of said second gear wheel, and driving means interconnecting the second gear wheel and the head assembly for rotating the head assembly in concert with the second gear wheel so as to be temporarily stationary when each suction head registers with the hopper, the number of concave profiled regions being equal to the number of suction heads.

10. A label applicator as claimed in claim 9 wherein said actuating means comprises a cam rotatable with the first gear wheel and a cam follower connected for reciprocating the hopper, the cam having a profile such that the hopper performs a single reciprocation each time said at least one smooth toothless sector of the first gear wheel engages in one of said concave profiled regions of the second gear wheel.

11. A label applicator as claimed in claim 1 and including a label magazine for carrying a fresh stack of labels for reloading the hopper, the hopper having an opening in an upper side through which the fresh stack can be dropped, the magazine being disposed to hold the fresh stack above the opening and aligned with the stack in the hopper, the magazine comprising a pair of openable flaps for supporting the fresh stack in the magazine, means resiliently holding the flaps closed so as to support the fresh stack and actuating means operable to open the flaps to drop the fresh stack into the hopper when desired.

12. A label applicator as claimed in claim 1 and including a conveyor and means for detecting articles to be labelled on the conveyor which means is operable on detection of such an article to initiate an operating cycle of the applicator, the detecting means comprising a bracket extending above the conveyor, at least one finger rotatably mounted to the bracket about a horizontal transverse axis to extend from the bracket downstream of the conveyor, the finger having a downstream end hanging beneath the bracket and positioned relative to the conveyor surface so as to be deflected by articles on the conveyor, and switch means operating on deflection of the finger by a predetermined amount to initiate an operating cycle of the applicator.

13. A label applicator as claimed in claim 12 wherein there are two said fingers in side by side relationship transversely spaced across the conveyor, said switch means being operable to initiate an operating cycle on deflection of either finger by a respective said predetermined amount.

* * * * *